US005992825A

United States Patent [19]

Vollenweider, II

[11] Patent Number: 5,992,825

[45] Date of Patent: Nov. 30, 1999

[54] PORTABLE EXPANSION DEVICE

[75] Inventor: Edward E. Vollenweider, II, Rochester Hills, Mich.

[73] Assignee: Technical Innovations, Inc., Troy, Mich.

[21] Appl. No.: 08/940,082

[22] Filed: Sep. 29, 1997

[51] Int. Cl.[6] ..... B66F 3/24; B66F 3/36

[52] U.S. Cl. ..... 254/93 R; 91/174; 91/176; 91/181; 91/182; 252/183.11; 261/DIG. 26; 422/133; 521/912; 60/205

[58] Field of Search ..... 252/183.11; 60/205; 91/174, 176, 181, 182; 261/DIG. 26; 422/133; 254/228, 93 R, 93 H; 521/912

[56] References Cited

U.S. PATENT DOCUMENTS

| | | | |
|---|---|---|---|
| 1,229,951 | 6/1917 | Hatch | 254/93 R |
| 2,483,239 | 9/1949 | Sharpe | 91/181 X |
| 2,487,920 | 11/1949 | Celenza | 91/176 X |
| 2,980,063 | 4/1961 | Litz | 91/181 X |
| 3,173,256 | 3/1965 | McMullen | 91/176 |
| 3,295,724 | 1/1967 | Brooks et al. | 422/133 X |
| 3,474,474 | 10/1969 | Busenkell et al. | 521/912 X |
| 3,523,679 | 8/1970 | Clay | 254/93 R |
| 3,769,232 | 10/1973 | Houldridge | 422/133 |
| 3,880,595 | 4/1975 | Timmerman | 60/205 X |
| 4,883,645 | 11/1989 | Pontius et al. | 422/133 |

FOREIGN PATENT DOCUMENTS

| | | | |
|---|---|---|---|
| 3532376 | 3/1987 | Germany | 254/93 R |

*Primary Examiner*—Richard D. Lovering
*Attorney, Agent, or Firm*—Harness, Dickey & Pierce, P.L.C.

[57] ABSTRACT

An expansion device for doing work comprised of a housing including first and second selectively expandable sections defining an internal chamber which contains a chemical motor. Upon activation of the chemical motor, the first and second chamber are driven apart with sufficient force to allow the device to do work. The chemical motor is generally an irreversible reaction which causes the expansion device to be maintained in an expanded position.

24 Claims, 3 Drawing Sheets

Fig-5

PORTABLE EXPANSION DEVICE

FIELD OF THE INVENTION

The present invention relates to a portable expansion device and, more particularly, to an expansion device capable of doing work by exerting force upon an object.

BACKGROUND OF THE INVENTION

Devices capable of doing work by exerting force upon an object generally are known. For example, U.S. Pat. No. 4,762,304 discloses a door opener which includes a piston which is driven by a hydraulic fluid. The door opener described consists of two hydraulic actuators which are adapted to act along in two different directions in a horizontal plane, with one of the directions being parallel or substantially parallel to the surface of the closed and locked door which is to be opened and the other direction being named to the door surface.

Still another device capable of doing work is disclosed in U.S. Pat. No. 5,329,685 which relates to a pneumatically-powered battering ram which includes a mass to be propelled such as a piston and a supply of compressed gas disposed within the housing. As the battering ram is swung at an object such as a door, the piston is activated to accelerate against the door at a higher velocity than could be achieved merely by swinging.

Although each of these mechanisms appear to be useful for their intended purposes, they also appear to be rather limited in their scope of use. Further, each such device as well as others such as automotive jacks tend to be unnecessarily complicated in constitution. In contrast, the present invention relates to a device capable of doing a variety of work which is of relatively simple construction, inexpensive to manufacture, lightweight, strong and easy to transport.

SUMMARY OF THE INVENTION

The present invention relates to an expansion device which includes a housing with first and second selectively telescoping sections which define an internal chamber. A chemical motor comprising a chemically reactive composition is contained within the internal chamber whereby upon reaction of the composition, the first and second telescoping sections are caused to move opposite each other with sufficient force to maintain the housing in an expanded position.

BRIEF DESCRIPTION OF THE DRAWINGS

Additional advantages and features of the present invention will become apparent from the subsequent description and the appended claims, taken in conjunction with the accompanying drawings in which:

DETAILED DESCRIPTION OF THE PREFERRED EMBODIMENT

Figure 1:
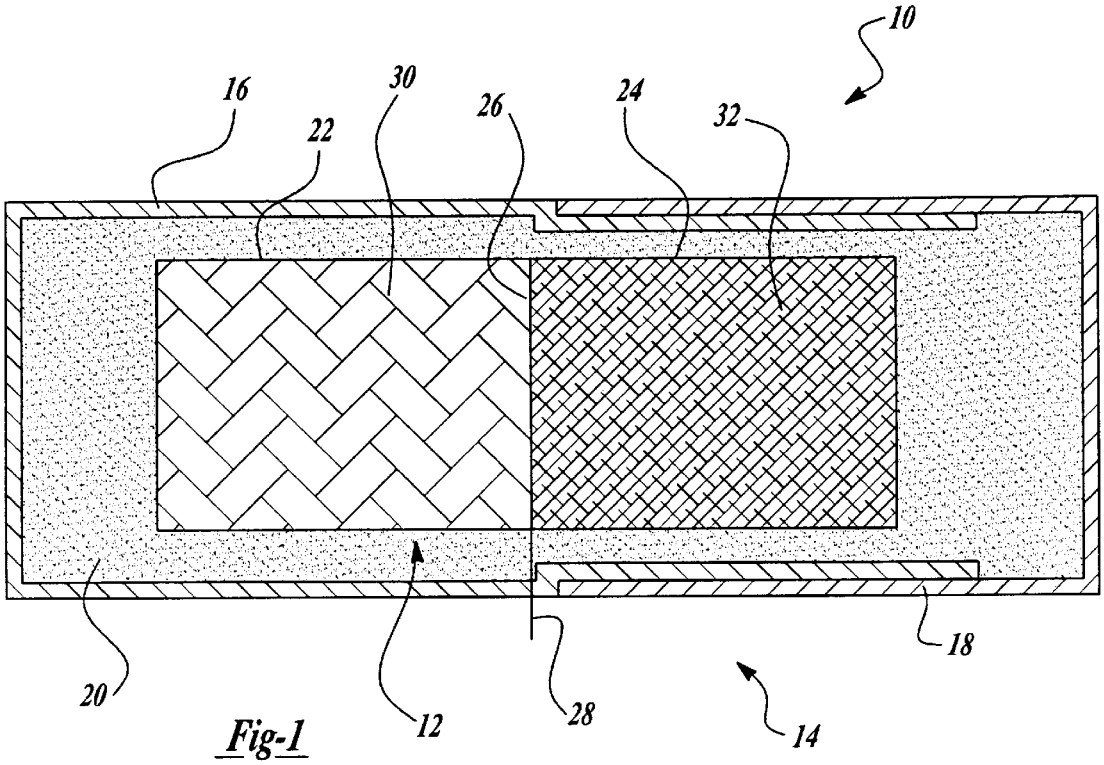
FIG. 1 is a cross-sectional view taken generally through the longitudinal centerline of the preferred embodiment for the expansion device.

A portable expansion device according to the teachings of the present invention is shown generally at 10 in FIG. 1. Expansion device 10 has housing 14 which includes a first selectively telescoping section 16 and a second selectively telescoping section 18. The first and second telescoping sections 16 and 18 define an internal chamber 20 which contains a chemical motor 12. Chemical motor 12 holds a chemically reactive composition.

With respect to the housing itself, the first and second telescoping sections can be formed from a variety of different materials including, in a non-limiting manner lightweight metals and high strength thermoplastics. The overall shape of the housing, particularly in the expanded position, is somewhat job specific depending on the intended use for the expansion device. For example, in the event that the expansion device is intended to be used as an automobile jack, at least one of the telescoping section ends should be conducive for resting upon a substantially flat surface and the end of opposing telescoping section should be conducive for attachment to or support of an automotive vehicle frame.

The chemical motor 12 is generally defined by first and second compartments 22 and 24, respectively, which are maintained separately by membrane 26. As illustrated in FIG. 1, different chemical constituencies 30 and 32, respectively, are contained within the first and second compartments 22 and 24 until the membrane 26 is caused to become ruptured by pulling pin 28 thereby allowing a chemical reaction to take place between the different chemical constituencies 30 and 32.

Figure 2:
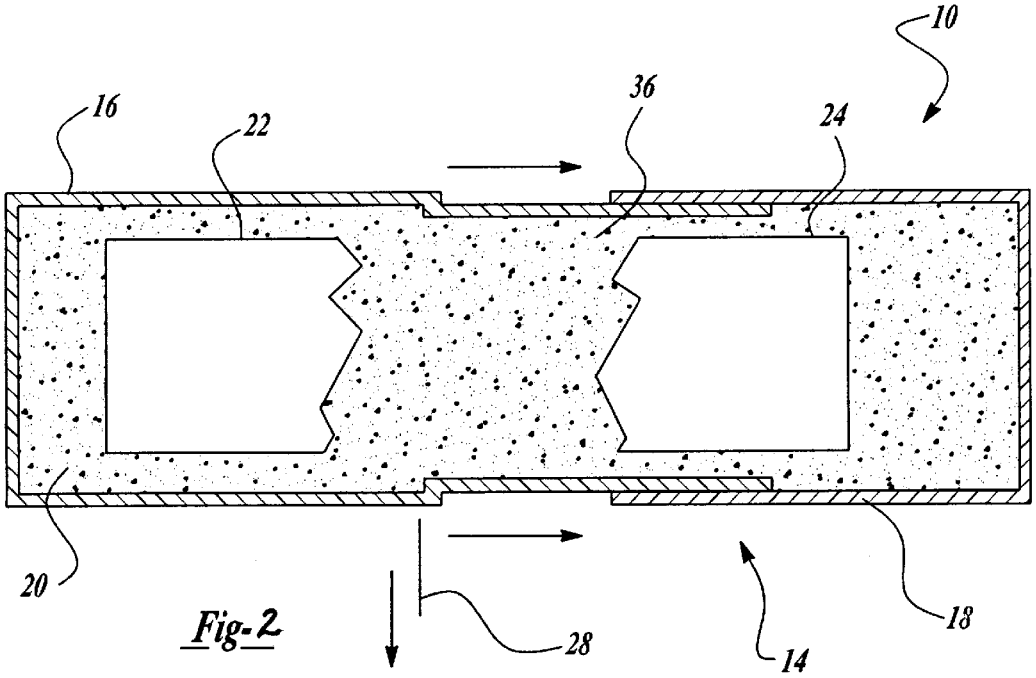
FIG. 2 is a cross-sectional view taken generally through the longitudinal centerline of the preferred embodiment for the expansion device after the expansion device has been activated.

As illustrated by FIG. 2, as a result of the chemical reaction between the previously separated chemical constituencies 30 and 32, the elongation or telescoping of the expansion device 10 occurs. The reaction causes at least one of the first and second telescoping sections 16 and 18 to move opposite the other with sufficient force to expand the device. Under a preferred embodiment not only is the device expanded, but also the device remains in the expanded position due to the nature of the chemical reaction occurring between the first and second constituencies 30 and 32.

For example, in a non-limiting manner, the first and second chemical constituencies 30 and 32 may be a polyisocyanate and a compound containing a blowing agent and hydrogen atoms which are reactive with the polyisocyanate to cause a voracious foaming which in turn causes the first and second telescopic sections to move away from each other along the same plane. In other words, the thermosetting foam which results from the reaction drives the telescoping sections apart thus expanding the device. Among the many useful foam formulations which may be employed polyester and phenolic foam formulations giving rise to highly rigid 36 foams are preferred.

As shown in FIGS. 1 and 2, the rupturing of the membrane 26 is effectuated by pulling pin 28 which is in contact with the membrane 26. This pulling action essentially causes the membrane 26 to be torn thereby allowing the reaction between the chemical constituencies designated by reference numerals 30 and 32.

Figure 3:
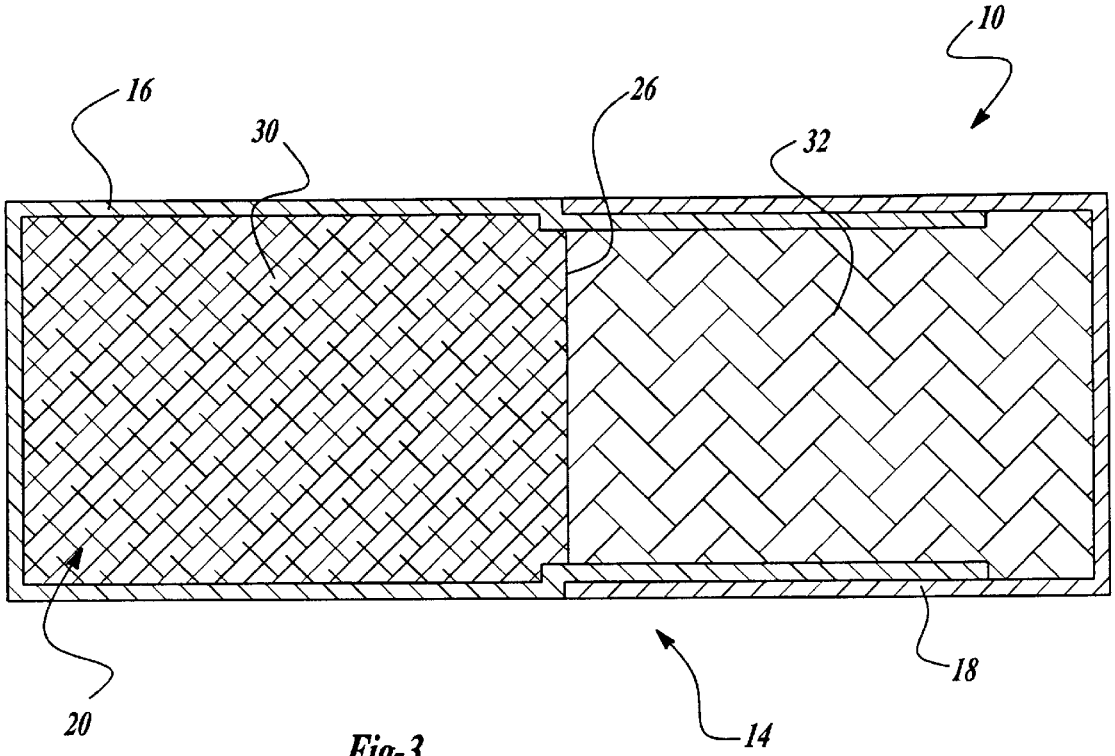
FIG. 3 is a cross-sectional view taken generally through the longitudinal centerline of an alternate embodiment for the expansion device.

Referring to FIG. 3 there is shown an alternate embodiment of expansion device 10. According to this alternate embodiment, the expansion device 10 is essentially identical to the device described with reference to FIGS. 1 and 2 except that the trigger mechanism for rupturing the membrane has been modified.

Figure 4:
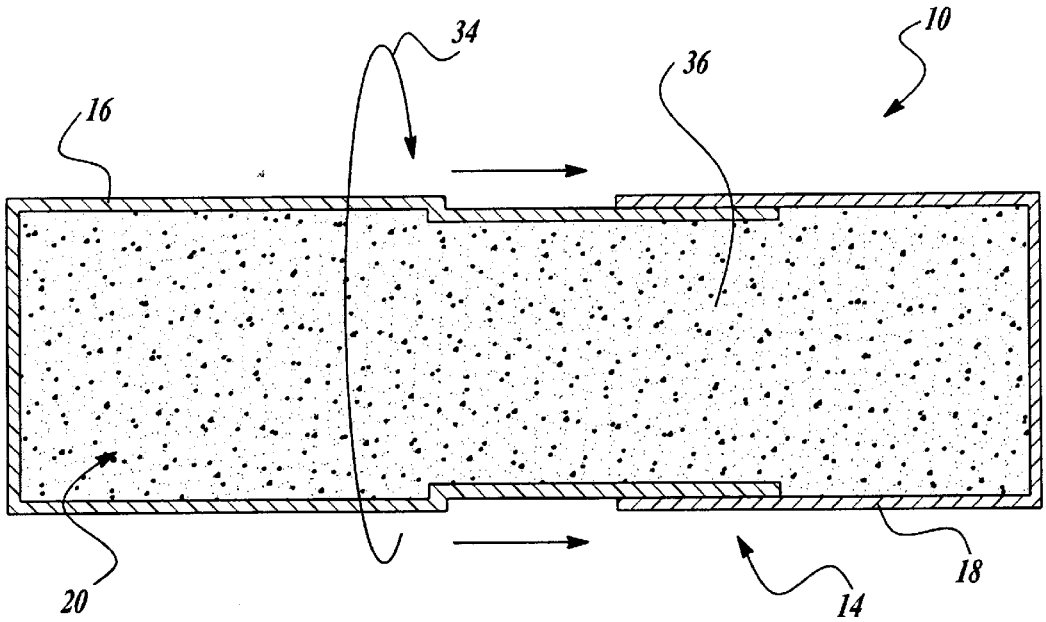
FIG. 4 is a cross-sectional view taken generally through the longitudinal centerline of an alternate embodiment for the expansion device after the expansion device has been activated.

As best illustrated in FIG. 4, instead of providing a pull pin or the like, expansion of the device is carried out via a twisting action as indicated by reference numeral 34. Upon twisting at least one of the sections 16 and 18, the membrane 26 becomes torn thereby allowing first chemical constituency 30 to react with second chemical constituency 32 thereby causing the telescoping effect. Again, due to the nature of the chemical constituencies, the chemical reaction is preferably substantially irreversible thus causing the device to remain in an expanded position upon actuation of the chemical motor 12.

Figure 5:
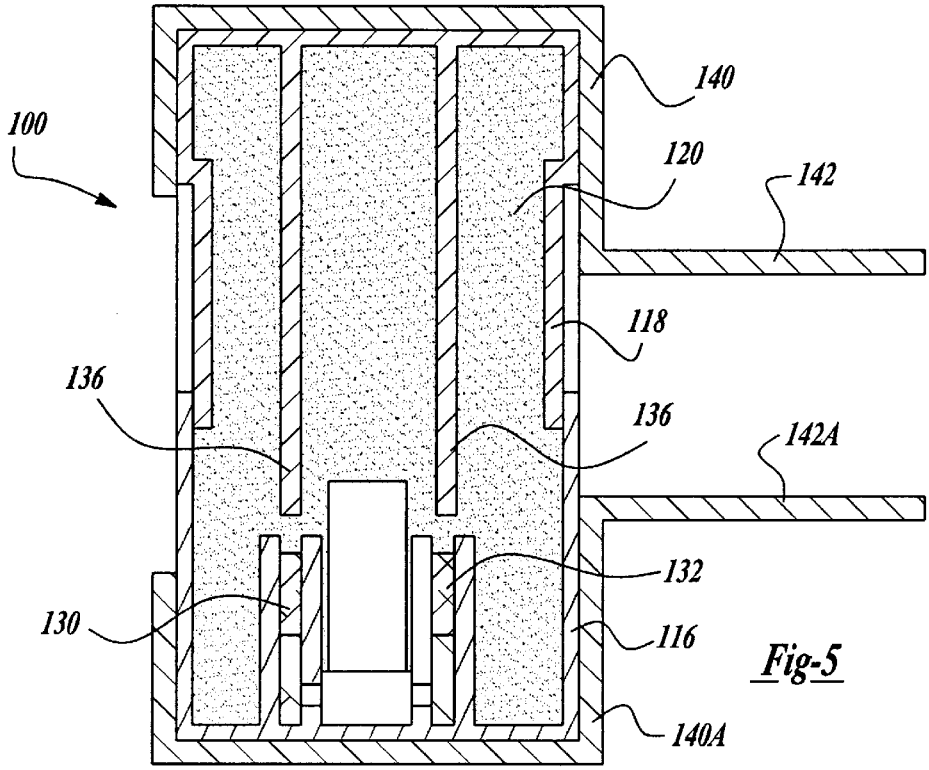
FIG. 5 is a cross-sectional view taken generally through the lateral centerline of an alternate embodiment for the expansion device.
Figure 6:
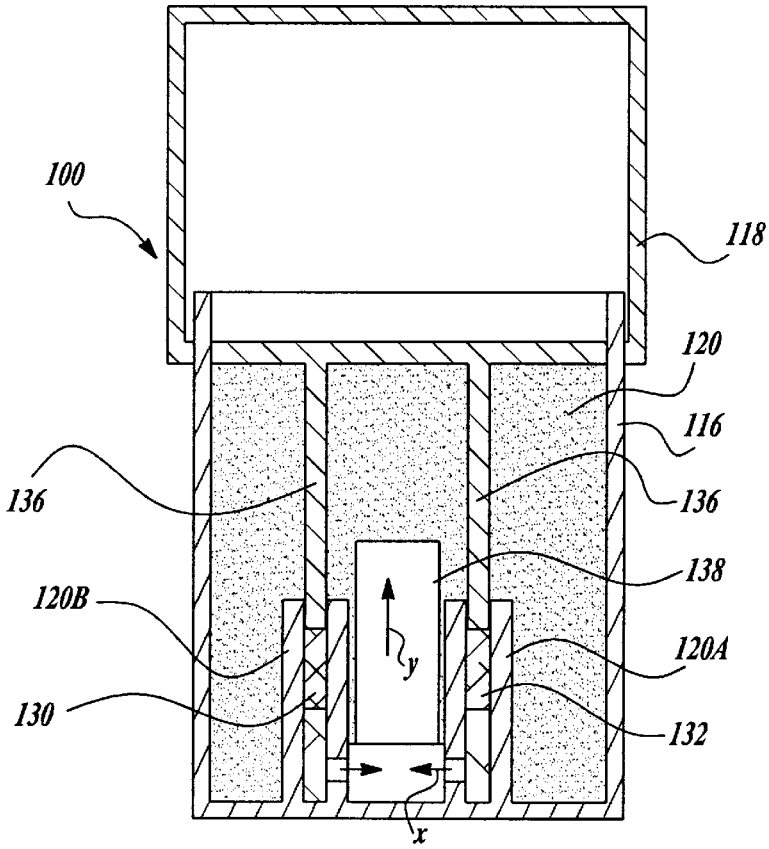
FIG. 6 is a cross-sectional view taken generally through the lateral centerline of an alternate embodiment for the expansion device.

Referring to FIGS. 5 and 6, alternative embodiments of the expansion device in accordance with the teachings of the present invention are illustrated. The expansion devices 100 again include a housing 114 defined by first and second telescoping sections 116 and 118, respectively. Contained within the first telescoping section 116 are receptacles 120A and 120B which separately maintain the chemical constituents 130 and 132 which comprise the chemical motor formed upon reaction thereof.

As illustrated most clearly in FIG. 5, the second telescoping section 118 includes pistons 136 which seat within the receptacles 120A and 120B. By advancing the pistons within the receptacles 120A and 120B, chemical constituents 130 and 132 are forced into reactive communication within the static mixer 138 as indicated by the arrows X and Y. Again, the reaction between the chemical constituents is sufficiently voracious to substantially fill the internal chamber 120 defined by the first and second telescoping sections 116 and 118 as to force the first and second telescoping sections 116 and 118 away from each other with enough force to do work. As illustrated in FIGS. 5 and 6, the pistons extending from the second telescoping section may originate at different locations provided they are sufficiently long so as to engage the respective chambers.

The expansion device 100 may be provided with selectively detachable caps 140 and 140*a*, as best illustrated in FIG. 6, which are retrofit over the first and second telescoping sections 116 and 118. The caps are tightly secured to the telescoping sections and are also made from a high strength material such as metal or certain plastics. The caps preferably include outwardly extending legs 142 and 142*a*, respectively, designed for use in prying an object under a confined space, i.e. such as bars on a window, for example. Thus, as should be understood by those skilled in the art, the selectively detachable caps work in conjunction with the various embodiments of the expansion devices described herein and are not limited only to those shown in FIGS. 5 and 6.

Examples of various applications for the expansion device 10 and 100 include disposing the device between bars of a window so as to allow access to burning buildings by the breaking of the bars. Other exemplary uses include opening door jams and lifting cars or other heavy objects via expansion device 10 and 100 off people who are pinned by such objects.

While it will be apparent that the preferred embodiments of the invention disclosed are well calculated to fulfill the objects stated, it will be appreciated that the invention is susceptible to modification, variation and change without departing from the spirit thereof.

What is claimed is:

1. An expansion device comprising:

a housing including first and second sections defining an internal chamber; and a chemical motor contained within said internal chamber comprising a chemically reactive composition whereby upon reacting said composition said first and second telescoping sections are caused to move opposite each other with sufficient force to maintain the housing in an expanded position.

2. The expansion device of claim 1, wherein said chemically reactive composition includes first and second chemical constituencies which are maintained separately from each other within said internal chamber prior to reaction.

3. The expansion device of claim 2, wherein said first chemical constituency is a polyisocyanate and said second chemical constituency contains a blowing agent and hydrogen atoms which are sufficiently reactive with said polyisocyanate to cause foaming within said housing.

4. The expansion device of claim 2, wherein said housing includes a membrane disposed within said internal chamber for selectively separating said first and second chemical constituencies before reacting said first and second chemical constituencies.

5. The expansion device of claim 4, wherein said housing includes means for rupturing said membrane such that said first and second chemical constituencies are in reactive contact.

6. The expansion device of claim 5 wherein said means for rupturing said membrane includes a pin selectively attached to said membrane.

7. The expansion device of claim 5 wherein said means for rupturing said membrane includes a twisting means, whereby upon twisting at least one of said telescoping sections relative to the other telescoping section said membrane becomes ruptured.

8. The expansion device of claim 2, wherein one of said first and second telescoping sections includes first and second receptacles coupled to a static mixer wherein said first and second receptacles separately maintain the first and second chemical constituents.

9. The expansion device of claim 8, wherein the other of said first and second telescoping sections include pistons which engage the first and second receptacles including the chemical constituents and force the chemical constituents into said static mixer thereby causing the chemical reaction.

10. The expansion device of claim 1 wherein said housing is of a size sufficient to be placed between bars of a window.

11. The expansion device of claim 1, wherein said housing includes first and second caps including opposed outwardly extending legs.

12. The expansion device of claim 11, wherein said first and second caps are useful as adaptors to carry out work in a confined space.

13. An expansion device for doing work comprising:

a housing including a first hollow cylinder at least partially disposed within a second mating cylinder, said first and second cylinders defining an internal chamber; and a chemical motor comprising first and second reactive constituencies separately maintained within said internal chamber;

whereby upon introducing said first and second chemical constituencies together said cylinders are driven apart thus causing the device to expand.

14. The expansion device of claim 13, wherein said chemically reactive composition includes first and second chemical constituencies which are maintained separately from each other within said internal chamber prior to reaction.

15. The expansion device of claim 14, wherein said first chemical constituency is a polyisocyanate and said second chemical constituency contains a blowing agent and hydrogen atoms which are reactive with said polyisocyanate to foaming with said housing.

16. The expansion device of claim 13, wherein said housing includes a membrane disposed within said internal chamber for selectively separating said first and second chemical constituencies before reacting said first and second chemical constituencies.

17. The expansion device of claim 16, wherein said housing includes means for rupturing said membrane such that said first and second chemical constituencies are in reactive contact.

18. The expansion device of claim 17 wherein said means for rupturing said membrane includes a pin selectively attached to said membrane.

19. The expansion device of claim 17 wherein said means for rupturing said membrane includes a twisting means, whereby upon twisting at least one of said telescoping sections relative to the other telescoping section said membrane becomes ruptured.

20. The expansion device of claim 13, wherein one of said first and second telescoping sections includes first and second receptacles coupled to a static mixer wherein said first and second receptacles separately maintain the first and second chemical constituents.

21. The expansion device of claim 20, wherein the other of said first and second telescoping sections include pistons which engage the first and second receptacles including the chemical constituents and force the chemical constituents into said static mixer thereby causing the chemical reaction.

22. The expansion device of claim 13 wherein said housing is of a size sufficient to be placed between bars of a window.

23. The expansion device of claim 13, wherein said housing includes first and second caps including opposed outwardly extending legs.

24. The expansion device of claim 23, wherein said first and second caps are useful as adaptors to carry out work in a confined space.

* * * * *